US011565223B2

(12) United States Patent
Bergamini et al.

(10) Patent No.: US 11,565,223 B2
(45) Date of Patent: Jan. 31, 2023

(54) DISPENSING MACHINE AND RELATED METHOD FOR PREPARING A USER-DEFINED FORMULATION BY DISPENSING FLUID PRODUCTS

(71) Applicants: Corob S.P.A., San Felice sul Panaro (IT); PPG Industries Ohio, Inc., Cleveland, OH (US)

(72) Inventors: Andrea Bergamini, Nonantola (IT); Giuseppe Casalini, Canegrate (IT); Joanne Sarah Thompson, Acton (GB); Alban R. D'Epenoux, Chigny (CH)

(73) Assignees: Corob S.P.A., San Felice sul Panaro (IT); PPG Industries Ohio, Inc., Cleveland, OH (US)

( * ) Notice: Subject to any disclaimer, the term of this patent is extended or adjusted under 35 U.S.C. 154(b) by 11 days.

(21) Appl. No.: 17/115,745

(22) Filed: Dec. 8, 2020

(65) Prior Publication Data

US 2021/0086149 A1 Mar. 25, 2021

Related U.S. Application Data

(63) Continuation of application No. PCT/EP2019/065084, filed on Jun. 10, 2019.

(30) Foreign Application Priority Data

Jun. 8, 2018 (IT) ..... 102018000006154

(51) Int. Cl.
*B67D 7/30* (2010.01)
*B01F 33/84* (2022.01)
(Continued)

(52) U.S. Cl.
CPC ..... *B01F 33/846* (2022.01); *B01F 31/201* (2022.01); *B01F 33/848* (2022.01);
(Continued)

(58) Field of Classification Search
CPC .... B01F 33/846; B01F 33/848; B01F 31/201; B01F 31/00; B01F 35/2115; B01F 35/43;
(Continued)

(56) References Cited

U.S. PATENT DOCUMENTS 4,323,097 A * 4/1982 Achen ..... B01F 33/84 141/168
5,835,982 A * 11/1998 Lanaro ..... G01G 13/024 177/244
(Continued)

FOREIGN PATENT DOCUMENTS

CN 105151349 B 7/2017
EP 0 056 170 A1 7/1982
(Continued)

OTHER PUBLICATIONS

International Search Report and Written Opinion, dated Mar. 9, 2019, in counterpart Application No. PCT/EP2019/065084 (10 pages).

*Primary Examiner* — Nicolas A Arnett
(74) *Attorney, Agent, or Firm* — Calderone Bullock LLC

(57) ABSTRACT

A dispensing machine for dispensing fluid products comprising a dispensing zone (15) in which elongated support means (12) are disposed, configured to support a plurality of removable containing units (11) of the fluid products in a stationary manner along a longitudinal axis (X) is disclosed. The dispensing zone (15) further includes translation means (20) configured to allow moving a receptacle (18) positioned on a metering unit and disposed on the translation means (20) substantially parallel to the longitudinal direction (X) to delivery positions substantially vertically below said containing units (11) and measurement means (16) configured to meter a quantity of fluid product that is delivered from a containing unit (11) to the receptacle (18) in a delivery position corresponding to the respective containing unit.
(Continued)

Also disclosed is the use of such dispensing machine for preparing customized formulations of fluid products as well as a method for preparing user-defined target formulation from a plurality of dispensable fluid products.

27 Claims, 8 Drawing Sheets

(51) Int. Cl.

| | |
|---|---|
| ***B67D 7/16*** | (2010.01) |
| ***B67D 7/84*** | (2010.01) |
| ***B01F 31/20*** | (2022.01) |
| ***B01F 35/43*** | (2022.01) |
| ***B01F 35/92*** | (2022.01) |
| ***B01F 35/71*** | (2022.01) |
| ***B01F 35/88*** | (2022.01) |
| ***B01F 35/21*** | (2022.01) |
| ***B01F 35/60*** | (2022.01) |
| *B01F 35/90* | (2022.01) |
| *B01F 101/30* | (2022.01) |

(52) U.S. Cl.
CPC ..... *B01F 35/2115* (2022.01); *B01F 35/43* (2022.01); *B01F 35/6052* (2022.01); *B01F 35/712* (2022.01); *B01F 35/714* (2022.01); *B01F 35/7176* (2022.01); *B01F 35/881* (2022.01); *B01F 35/92* (2022.01); *B67D 7/163* (2013.01); *B67D 7/302* (2013.01); *B67D 7/84* (2013.01); *B01F 2035/99* (2022.01); *B01F 2101/30* (2022.01)

(58) Field of Classification Search
CPC ... B01F 35/881; B01F 35/92; B01F 35/21111; B01F 35/21112; B01F 35/605; B01F 35/717; B01F 35/7174; B01F 35/718; B01F 2101/30; B01F 2035/99; B67D 7/163; B67D 7/302; B67D 7/84
See application file for complete search history.

(56) References Cited

U.S. PATENT DOCUMENTS

| | | | | |
|---|---|---|---|---|
| 5,934,344 | A * | 8/1999 | Wainberg | B01F 33/84 222/164 |
| 5,938,080 | A * | 8/1999 | Haaser | B01F 35/8822 222/144.5 |
| 8,528,605 | B2 * | 9/2013 | Smith | B01F 33/846 141/105 |
| 8,752,594 | B2 * | 6/2014 | Gebhard | C09D 7/80 427/160 |
| 2005/0189037 | A1 * | 9/2005 | Cortes Ferriz | B01F 35/71805 141/102 |
| 2019/0143285 | A1 * | 5/2019 | Sang | B41F 31/03 366/141 |

FOREIGN PATENT DOCUMENTS

| | | | |
|---|---|---|---|
| EP | 0 769 686 | A2 | 4/1997 |
| WO | WO 2017211196 | A1 | 12/2017 |

* cited by examiner

DISPENSING MACHINE AND RELATED METHOD FOR PREPARING A USER-DEFINED FORMULATION BY DISPENSING FLUID PRODUCTS

CROSS-REFERENCE TO RELATED APPLICATIONS

This application is a continuation application of and claims priority under 35 U.S.C. § 120 and priority under 35 U.S.C. §§ 363, 365 to International Patent Application No. PCT/EP2019/065084, filed Jun. 10, 2019, which was published in the English language, and which claims priority under 35 U.S.C. § 119 to Italian Application No. 102018000006154, filed Jun. 8, 2018. The entire disclosures of these applications are incorporated herein by reference.

BACKGROUND OF THE INVENTION

Field of the Invention

The present invention concerns a dispensing machine for dispensing fluid products able to meter the quantity of product that is delivered and its use for preparing user-defined formulations, such as paint formulations, particularly in the field of refinishing or repair applications. It also concerns a method for preparing a user-defined formulation from a plurality of dispensable fluid products.

Description of Related Art

The preparation of a complex formulation from a number of available fluid ingredients according to a user-defined recipe is encountered in many different fields, for example in automotive body shops a customized paint formulation has to be prepared, which accurately matches the color of the car to be repaired as already slight deviations between the original paint on undamaged portions of the car and the paint used for repair will be visible to an observer.

Therefore, different machines dispensing coloring fluid products configured to deliver a plurality of such products into a receptacle according to a predetermined delivery sequence to provide a desired formulation to an operator have been developed.

An example of a dispensing machine known in the art is described by the international patent application number WO-A1-2016/081818.

Other versions of dispensing machines known in the art are described, for example, in U.S. patent applications US-A1-2011/0101028, US-A1-2011/0108577 and US-A1-2014/0346191.

These dispensing machines known in the art comprise a plurality of containers of coloring fluid products disposed on a mobile support element configured as a carousel, or wheel, rotatable around a central axis of rotation.

A movement mechanism moves the mobile support element to position selected containers one after the other into a delivery position according to a predefined sequence, which is a function of the desired color formulation. A weighed amount of coloring fluid product is each dispensed from the selected containers to a receptacle on a scale disposed below the container in the delivery position to produce the desired color formulation in the receptacle.

A disadvantage of the afore-mentioned dispensing machines known in the art is that they have a rigid and bulky design such that they are not ideally suited to be disposed in narrow or not very spacious work environments as frequently encountered for example in body shops and require relatively long and laborious maintenance operations. Moreover, they are not ideally suited for manual handling as the receptacle to be filled with the desired formulation may be difficult to access for the operator. Also, generally only a part of the containers of fluid product are readily accessible to the operator in a given position of the carousel or wheel such that an exchange of the containers generally requires movement of the rotary mechanism.

An automatic ink color blending apparatus known in the art is also disclosed in International patent application no. WO-A1-2017/211196.

This apparatus comprises a cabinet, wherein an ink bucket as a receptacle is provided on a scale placed on a platform, which can be moved below a row of suspended ink supply devices, each containing an ink of different chromaticity. Each ink supply device comprises a flexible bag containing the ink and a couple of rollers configured for squeezing the bag in order to obtain the ink delivery. The ink supply devices are mounted on the cabinet by means of a supply device bracket, which allows a sliding movement of the ink supply devices from their installed position to a maintenance position, in which the exhausted bag can be replaced by another filled one. Installation of a bag requires manually sandwiching the bag at its top between the pair of rollers, making connections to an ink pump and outlet tube and fixing the bottom outlet of the flexible bag to a fixing device that is slidable along a vertical rail of the supply device bracket disposed below the pair of rollers. Installation of a bag is thus laborious and time-consuming. The installed flexible ink bag and associated pump means moreover rise and fall upon operation of the device, i.e. are mounted in a moveable manner. The complex mount involving movable parts renders the apparatus error-prone.

Furthermore, only a small number of ink supply devices are provided for in this machine, thus not allowing to readily produce a great variety of different formulations. Therefore, a disadvantage of this solution is also the low productivity and low flexibility of the apparatus.

Another disadvantage of this solution is the low precision obtainable during the delivery due to the intrinsic limits of this system formed by the rollers squeezing the bag, which does not allow to reach a high precision and reliable accuracy in the delivery.

There is therefore a need for a dispensing machine for fluid products and a method for preparing user-defined formulations from dispensable fluid products, which overcome at least one of the afore-mentioned disadvantages of the state of the art.

It is therefore a purpose of the present invention to make available a dispensing machine for fluid products and a related method for preparing user-defined formulations which overcome one or more, such as one, some or all, of the afore-mentioned deficiencies of the prior art. They should thus ideally allow to obtain a desired formulation from a plurality of fluid products according to predetermined proportions in a reliable, fast, safe and economic manner enabling the accurate provision of target formulations with a high throughput, without requiring long and laborious maintenance operations.

The dispensing machine should have a compact and flexible design enabling use in confined spatial environments and allow for convenient use by an operator. The machine and method should yet allow to readily obtain a large number of different formulations such as the large variety of color formulations encountered in automotive refinish applications.

The Applicant has devised, tested and embodied the present invention to overcome the shortcomings of the state of the art and to obtain these and other purposes and advantages.

BRIEF SUMMARY OF THE INVENTION

The present invention is set forth and characterized in the independent claims, while the dependent claims describe optional features of the invention or variants to the main inventive idea.

In accordance with the above purposes, according to the invention a dispensing machine for dispensing fluid products is provided, comprising elongated support means, configured to support a plurality of removable containing units of the fluid products in a stationary manner along a longitudinal direction (X). The dispensing machine further comprises translation means configured to allow moving a receptacle disposed on the translation means substantially parallel to the longitudinal direction (X) to delivery positions substantially vertically below said containing units and metering means configured to meter a quantity of fluid product that is delivered from a containing unit to the receptacle in a delivery position corresponding to the respective containing unit.

With the term "removable" it is intended to express that the containing units can be reversibly removed from the support means. Accordingly, they can manually be detached from the support means (and thereby also the dispensing machine as a whole) in a non-destructive manner and be placed in the same or other support means of the dispensing machine again. This process could be carried out for a theoretically infinite number of times. Consequently, the different removable containing units can be readily exchanged between different positions of the dispensing machine, such as between a position in a storage zone and a position in a dispensing zone or vice versa, contributing to the flexibility and ease of use of the dispensing machine of the present invention.

The present invention also relates to the use of such a machine according to the present invention as described above and in more detail below for preparing user-defined formulations of fluid products.

The present invention is also directed to a method for preparing a user-defined formulation from a plurality of fluid products. This method comprises:

(a) providing a plurality of fluid products each in a containing unit;

(b) mounting the containing units of the fluid products to elongated support means configured to support the plurality of containing units of the fluid products in a stationary manner along a longitudinal direction (X);

(c) placing a receptacle intended for receiving fluid product from the containing units on translation means configured to allow moving the receptacle substantially parallel to the longitudinal direction (X) to delivery positions substantially vertically below said containing units;

(d) moving the receptacle via the translation means to a dispense position corresponding to a selected one of the containing units of fluid products;

(e) dispensing a quantity of the fluid product as metered by a metering means from the selected containing unit into the receptacle;

(f) repeating steps (d) and (e) to produce the user-defined formulation according to a predetermined recipe.

The method according to the present invention can in particular be carried out using a dispensing machine of the present invention as described herein.

It is a characteristic advantage of the present invention that the co-linear arrangement of the containers of the fluid product and the translation means carrying the receptacle is much less bulky and more flexible compared e.g. to the afore-mentioned circular configurations known from the art enabling use in confined spatial environments, such as positioning in a niche or against a wall. Thus, the method and machine of the present invention allow for the use of an adequate number of containing units (for example up to thirteen) that allow to obtain a large number of variant formulations, while still maintaining the dimensions rather compact. The configuration of the present invention enables moreover easy access of the operator to all mounted containers of the fluid products as well as to the receptacle allowing for convenient manual operations and avoids laborious maintenance operations. The dispensing machine and method according to the present invention allow to obtain a desired formulation from a plurality of fluid products according to a user-defined recipe in a reliable, flexible, safe and economic manner with high accuracy and speed. For example, a quantity of a target formulation prepared from five different fluid products as typically required for automotive refinishing applications can be provided according to the present invention in less than five minutes time and with an accuracy of ±0.02 g per ingredient.

The fluid products used in accordance with the present invention can in particular comprise or be coloring fluid products. The present invention is accordingly particularly useful for preparing color formulations. It can for example be used to provide user-defined paint formulations, particularly for refinishing or repair purposes, for example in a body shop for painting a vehicle body.

These and other optional aspects, characteristics and advantages of the present disclosure will be better understood with reference to the following description, drawings and attached claims. The drawings, which are integrated and form part of the present description, show some non-limiting forms of embodiment of the present invention, and together with the description, are intended to describe the principles of the disclosure.

BRIEF DESCRIPTION OF THE SEVERAL VIEWS OF THE DRAWINGS

In the Attached Drawings.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF THE INVENTION

Figure 1:
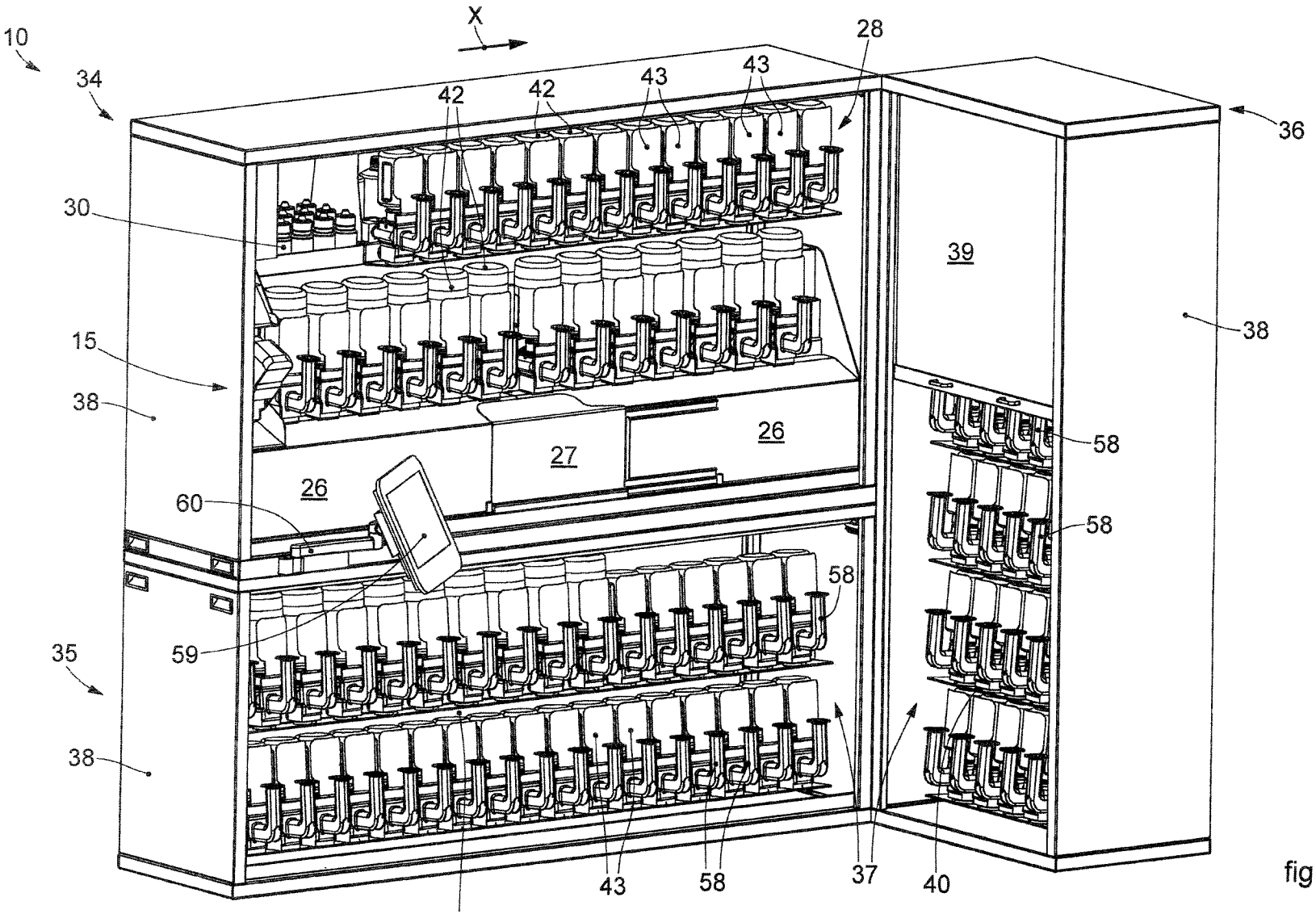
FIG. 1 is a perspective view of an embodiment of a dispensing machine for dispensing fluid products according to the present invention.

The present invention relates to a dispensing machine that is designed and configured as set forth above. The machine generally comprises a dispensing zone, i.e. a zone wherein fluid product is dispensed from containing units to prepare a targeted formulation in a provided receptacle. The dispensing zone typically comprises the elongated support means, the containing units of the fluid products mounted to the elongated support means from which the fluid product is dispensed. The dispensing zone usually further comprises the translation means for moving a receptacle disposed thereon and the metering means configured to meter a quantity of fluid and may optionally contain some further optional elements described below.

The dispensing machine comprises support means, which are configured to support a plurality of containing units of the fluid products. The support means generally have an elongated structure, meaning they have an extension in one preferential direction, which is larger than its dimensions in other spatial directions. The elongated support means can for example have a linear structure. Typical non-limiting examples include a rail, rod or alike. The elongated support means can be connected to other structural members of the machine such as a support frame holding them in place. The elongated support means are typically disposed in the dispensing zone with the preferential direction oriented substantially parallel to the ground. The term "substantially" as used herein with respect to certain spatial arrangements, such as for example "substantially parallel", "substantially vertically below" or alike, means that the respective elements referred to are arranged in the designated manner, for instance parallel or vertically below, or in a configuration with a minor deviation from the designated relative arrangement, such as having an offset angle of less than 5 degrees, less than 2 degrees or less than 1 degree therefrom. The support means support a plurality of containing units of the fluid products along a longitudinal direction (X). Typically, the containing units are arranged next to each other in a row along the preferential direction of the elongated support means. The support means support the plurality of containing units of the fluid products in a stationary manner. "Stationary" supported as used herein means that the containing units are maintained in place and substantially do not move during operation of the machine. Thus, the mounted containing units generally do not move (e.g. in a lateral and/or vertical direction) upon operation of the dispensing machine. The support means accordingly typically comprise no moving parts, which contributes to reliability and low maintenance requirements of the dispensing machine of the present invention. For example, the support means can comprise a plurality of fixtures each shaped so as to receive and retain a coupling portion comprised in each of said containing units. Different types of couplings allowing a reversible mounting as known from the art can be used such as for example, without being limited thereto, lock-key couplings, mating shape couplings, threaded couplings, snap-fit couplings or alike. The coupling portion of the containing unit can for example have a shape mating with the shape of the fixture so as to be insertable in, and completely detachable from, the fixture. For example, the fixtures can each provide a bay or port into which a coupling portion of a containing unit of mating shape can be inserted, and which provides structural support to maintain the inserted containing unit in place. The containing units typically comprise a container that contains the fluid product, and a body to which the container is removably connected. The coupling portion can for example be formed by a part of the body of the containing unit to which a container containing the fluid product is mounted. The body may house means for the delivery of the fluid product from the container as set forth in more detail below. The containing units can be held by fixtures in a specific orientation such as for example with their bottom facing upwards (e.g. such that an opening of the container containing the fluid product faces downward) or any other desired orientation. The coupling portion of the containing units can be specific to a manufacturer of the fluid products. The containing units are removable from the support means thus allowing to mount containing units of a variety of different fluid products in accordance with the needs to prepare a specific targeted formulation and to allow for a replacement of a containing unit once its content has been consumed. The shape and dimensions of the containing units are not particularly limited, but should allow for a reasonable handling by an operator and sufficient contained fluid product for common formulation purposes. Typically, the containing units or containers comprised thereby contain a volume of fluid product in the range from 0.1 liters up to 5 liters, preferably 0.5 to 2 liters.

As mentioned above, the dispensing zone of the machine of the present invention further comprises translation means configured to allow moving a receptacle disposed on the translation means substantially parallel to the longitudinal direction (X) to delivery positions substantially vertically below said containing units. The translation means can comprise any means suitable for a linear movement, such as for example a conveyor belt, a roller assembly or a linear slide system. Preferably, the translation means comprise a slider for carrying the receptacle and linear guide means, such as rails, that extend substantially parallel to the longitudinal direction (X), wherein the slider is moveable on the linear guide means. The dispensing machine according to the present invention may comprise actuation means such as an electrical drive motor, associated with the translation means for moving said translation means along the longitudinal direction (X). For instance, the actuation means, such as an electrical motor, can be associated with the linear guide means in order to move the slider in the longitudinal direction (X).

As mentioned above, the dispensing machine further comprises metering means configured to meter a quantity of fluid product that is delivered from a containing unit to the receptacle in a delivery position corresponding to the respective containing unit. The metering means can comprise for example weighing means or volume measuring means for measuring the weight or the volume of the dispensed quantity of fluid products, respectively. Preferably, the metering means comprise weighing means, such as a digital scale, disposed on the translation means to receive resting on it the receptacle for receiving the delivered fluid products.

According to the present invention the dispensing machine may further comprise delivery means for dispensing fluid product from the containing units. The delivery means can comprise any means suitable for delivering a fluid product from a container in a controlled manner such as for example a piston assembly, a vacuum or pressurizing system or a pump assembly. The delivery means may further comprise one or more valves and/or conduits for defining a fluid pathway from the container of the fluid product to the outlet for dispensing the fluid product to the receptacle. For example, the containing units may each comprise a container that contains the fluid product, and a body comprising a pump assembly, one or more valve elements and a pipe arrangement able to lead the fluid products from the container to said receptacle.

In a preferred variant, the translation means or a component thereof such as the afore-mentioned slider, comprises drive means configured to interact with a respective containing unit of the fluid product in order to command the delivery of the latter by selectively driving a pump assembly and one or more valve elements that are integrated in a body of the containing unit.

The dispensing machine according to the present invention may further comprise a controller operationally linked to the afore-mentioned actuation means, metering means, and delivery means, if present. The controller may be configured to command the actuation means to move the receptacle via the translation means sequentially to the dispense positions below one or more of the containing units. It may furthermore be configured to control the delivery means to deliver fluid product from a containing unit when the receptacle is in the dispense position below the respective containing unit. The controller can further be configured to each control the quantity of fluid product dispensed from the respective containing unit in response to a signal from the metering means to produce a formulation according to a user-defined recipe. The controller can comprise one or more processors, which can be programmed to perform the above functions. The controller can be part of, or connected to, a computer system that enables a user to control operation of the machine and to define the formulation to be produced thereby.

Optionally the dispensing machine according to the present invention can further comprise detection means configured to detect an identity code univocally associated with each of said containing units. The detection means can for example comprise optical detection means such as an optical bar code reader. Alternatively, the detection means can comprise suitable means that are able to recognize the identity code that is univocally associated with each containing unit, based on RFID or NFC technology, which are known as such in the art. The detection means can for example be coupled to, or comprised by, the translation means or a component thereof such as the above-mentioned slider. The detection means can be operatively linked to a controller, such as the controller described above, enabling the machine to detect which fluid product is contained in which containing unit in the dispensing zone and use that information in the sequential preparation of the targeted formulation.

Furthermore, the dispensing machine of the present invention typically comprises a removal position where said receptacle is accessible to the operator. The removal position is configured such that the operator has access to the receptacle when it is in the removal position, so that the operator can remove the receptacle, for example a receptacle filled with a formulation of fluid products at the end of a delivery sequence, load a new empty receptacle and/or perform other manual operations such as a manual addition of one or more ingredients to the receptacle. The removal position can for example be disposed approximately in a median position of the dispensing machine with reference to the longitudinal direction (X), such as at a position in a range of from 40 to 60% of the total length of the support means in the longitudinal direction.

The dispensing machine may for example comprise protection elements that shield at least the translation means, preferably the entire dispensing zone except for the removal position, if present, from the operator to prevent the operator from coming into contact with the mobile parts during operation of the machine. The protection elements can preferably be transparent, such as made of transparent glass or plastic sheets, which enables an operator to visually follow operation of the machine. The protection elements can be provided with a door, which can be opened in order to access the removal zone. The door can be selectively secured in the closed position at least when said translation means is moving. This contributes to a reliable and safe operation of the machine.

The dispensing machine according to the present invention may optionally comprise one or more than one storage zone(s) besides the afore-mentioned dispensing zone. A storage zone is configured to store a plurality of containing units of fluid products outside the dispensing zone. The storage zone can comprise support means to support the containing units of fluid products. The support means and containing units of fluid products can be of the type as described above in the context of the dispensing zone. The storage zone does not significantly increase the overall bulk of the machine since it can also develop in a linear configuration parallel to the longitudinal direction. The storage zone(s) can for example be configured to comprise one or more than one row of containing units disposed below and/or above the row of containing units disposed in the dispensing zone. Due to the storage zone(s), a large number of containing units are readily available from which the operator can select those to be disposed in the dispensing zone, according to the color formulation desired.

The storage zone may optionally comprise an auxiliary compartment in which jars or bottles can be disposed containing additives or other substances that the operator may wish to use, e.g. add manually to the receptacle at the end of delivery, in a formulation process. This is certainly a convenient and tidy disposition that allows the operator to find materials for potential use in the formulation process quickly and easily close to where they are actually used.

The dispensing machine of the present invention may moreover optionally comprise an additional storage shelf that is placed in a storage zone. For example, the additional storage shelf can be disposed above the dispensing zone and extend parallel to the longitudinal direction to store a row of containers filled with respective fluid products. In this manner, spare containers, for example containing the most consumed fluid products, can be stored directly inside the machine to be immediately available for being associated to a body of a containing unit, e.g. when a corresponding container finishes.

According to the present invention the dispensing machine may optionally comprise heating means and temperature sensor means. The heating means can be provided in or in close proximity to the dispensing zone and/or in or in close proximity to one or more of the storage zone(s), if present. The heating means can for example be disposed within or in proximity to a storage zone (i.e. outside the dispensing zone) in order to heat the containing units stored therein. The heating can be controlled in response to the temperature detected by said temperature sensor means. For example, the heating means can be activated or their heating power increased when the temperature detected by the sensor means is below a certain threshold. Use of the heating means enables to heat the dispensing zone and/or the storage zone to adequate use or storage temperatures in order to prevent the colorant from drying out or solidifying, which may be caused by excessively low temperatures.

Furthermore, the dispensing machine may optionally comprise coverage means associated to the dispensing zone and/or to one or more than one storage zone configured to store a plurality of containing units of fluid products outside said dispensing zone, if present. The coverage means can for example comprise shutters and/or blinds that are configured to allow reversibly closing the dispensing zone and/or storage zone(s) in order to protect the containing units disposed therein. The coverage means facilitate both to keep the storage zones dust free and to retain heat inside the respective zones so as to slow their cooling. The coverage means also provide advantageously areas that can be used for branding for example by customizing it with a logo, brands and/or advertising message.

The dispensing machine of the present invention may moreover optionally contain one or more than one auxiliary devices. Thus, it can for example comprise a printing device configured to print adhesive labels suitable to adhere to the receptacle. It can also comprise a spectrophotometer device suitable to analyze color formulations delivered by the dispensing machine. Other optional auxiliary devices that can be used according to the present invention include, without being limited thereto, an electronic device, such as a computer and/or a display, as also mentioned above in the context of the controller, and/or a shaker device able to shake the formulations delivered in said receptacle. Such auxiliary device(s) can be provided for example in a dedicated compartment outside the dispensing zone, e.g. in a storage zone. Integrating such auxiliary device(s) like a printing device and/or a spectrophotometer, provides the operator with a suitable workspace and helpful tools on board the machine contributing to make the operator's work more efficient and convenient.

A further advantage of the dispensing machine according to the present invention is that it can be formed from sectional modules, which allow optimized use of the space available in the work environment where the machine is located. Thus, the machine can comprise a main module in which at least the dispensing zone is disposed, and other modules comprising storage zones for the containing units of the fluid products. For example, the dispensing machine according to the present invention can comprise a plurality of joined sectional modules. The dispensing machine thus may comprise a main module that comprises at least said dispensing zone and optionally one or more storage zone(s), and one or more additional module(s) comprising other storage zones for containing units of the fluid products forming a main cabinet. Optionally one or more further module(s) comprising additional storage zones for containing units of the fluid products forming one or more than one secondary cabinet can be present. The main cabinet typically has a width of equal to or less than 2.0 m, a height of up to 2.0 m and/or a depth of equal to or less than 60 cm. The optional secondary cabinet can for example have a width of equal to or less than 80 cm, a height of up to 2.0 m and/or a depth of equal to or less than 60 cm. The modules can be joined by any suitable connection means such as fasteners, hinges, snap lock mechanisms or alike. The possibility of using modules in addition to the main module for providing further ample storage zones allows to have a large number of containing units readily available to the operator at the point of use. The operator may then choose those to be disposed in the dispensing zone according to his needs. A modular configuration of the dispensing machine according to the present invention allows to easily adapt to the different spatial requirements of existing work zones and allows for a use even in narrow and confined areas.

The dispensing machine of the present invention may moreover optionally comprise visual signaling means associated with the dispensing zone to inform the user about the state of the dispensing cycle or of the machine. The visual signaling means can for example comprise one or more led lights, for instance in the form of strips of led lights. The visual signaling means can be configured to assume different colors for different operating steps of the dispensing machine or to indicate other status information such as being in operation or occurrence of a malfunction. In this way, a user that is possibly positioned also at a distance from the dispensing machine can be informed about the operational status of the latter.

The dispensing machine of the present invention may moreover optionally comprise a roll bar unit comprising an elongated rod extending parallel to the longitudinal direction and supported by brackets connected to the frame in a hinged-like manner so as to allow a movement of said roll bar unit between a lowered and a raised position, in which respectively the elongated rod prevents or allows the insertion of said containing units in the dispensing zone or their removal therefrom. Preferably, the dispensing machine may further comprise an electrically commanded control member that is operationally associated to the roll bar unit and configured to be in contact with the brackets so as to alternatively assume an open configuration, in which the dispensing machine is not powered, at least when the roll bar unit is in the raised position, and a closed configuration, in which the dispensing machine is powered, at least when the roll bar unit is in the lowered position. The optional roll bar unit thus may contribute to a safe operation of the dispensing machine by users.

With reference to the drawings, we will now describe an exemplary dispensing machine for fluid products in accordance with the present invention, indicated in its entirety by the reference number 10. The dispensing machine and components thereof depicted in the appended Figures are intended for illustration of the invention and shall not be understood as a limitation thereof. For example, the characteristics shown or described insomuch as they are part of one embodiment can be adopted on, or in association with, other embodiments to produce another embodiment. It is understood that the present invention shall include all such modifications and variants.

The dispensing machine 10 allows to deliver a metered quantity from a plurality of containing units of the fluid product. A single containing unit for the coloring fluid product, better seen in FIG. 6 or FIGS. 8 and 9, is indicated in its entirety by the reference number 11.

The dispensing machine 10 comprises support members 12 which function as support means to support the containing units 11.

Figure 6:
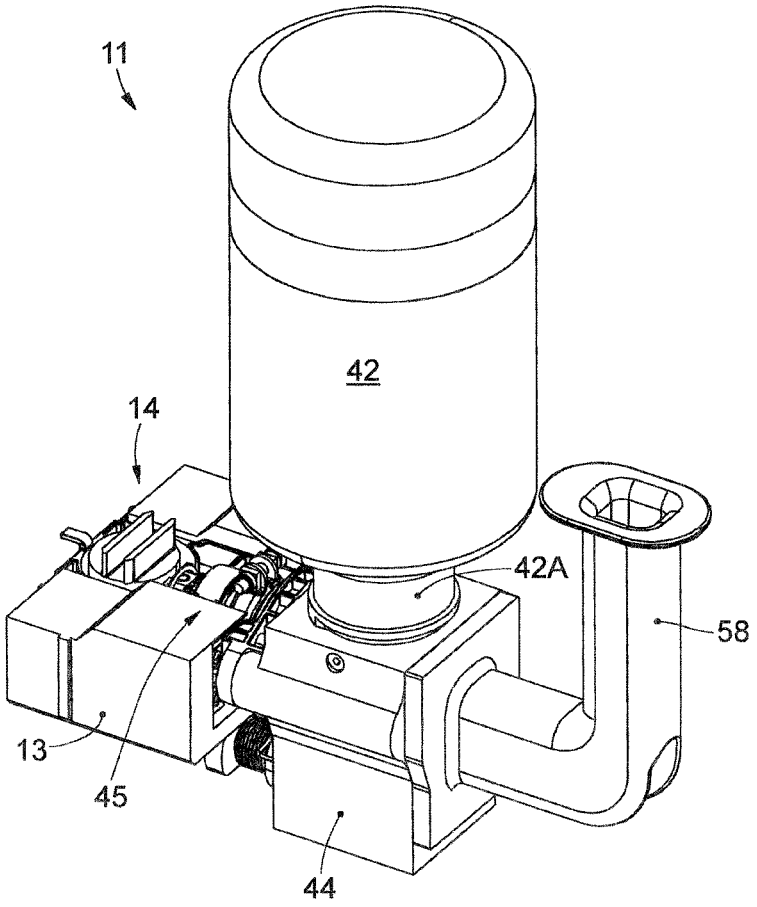
FIG. 6 is a perspective view of a containing unit associated with support means of the dispensing machine of FIG. 1.
Figure 8:
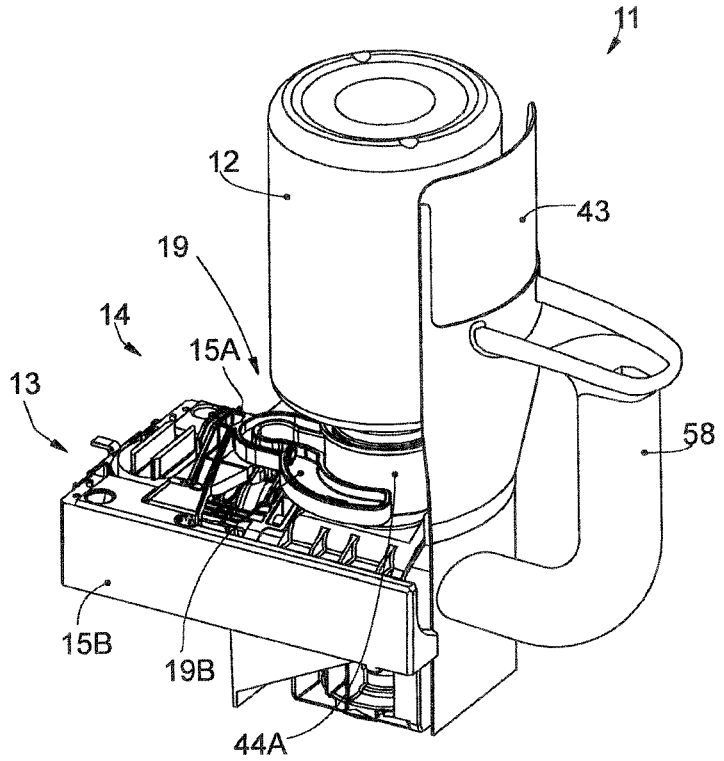
FIG. 8 is a view like the one of FIG. 6 in which it is visible another version of a containing unit comprised in the machine that is mounted on a fixture provided in support means of the dispensing machine.
Figure 9:
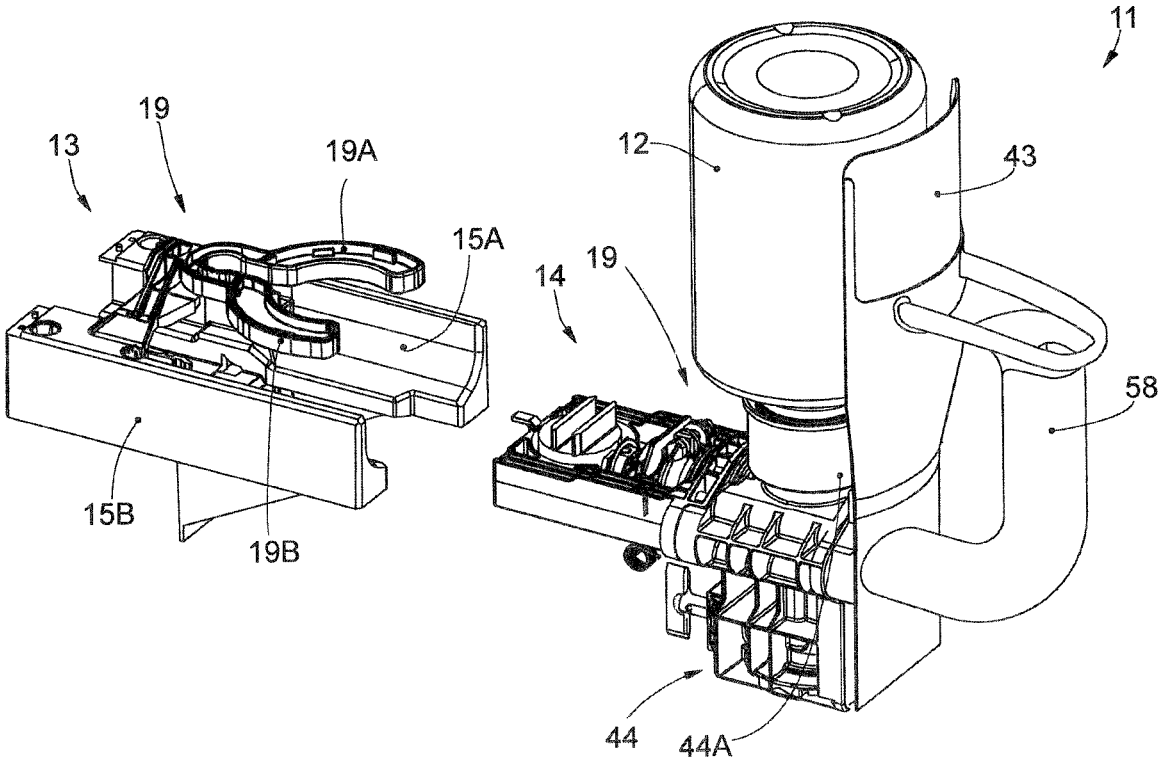
FIG. 9 is an exploded perspective view of the containing unit of FIG. 8.

According to the present invention, the support members 12 may comprise a plurality of fixtures 13, one of which is visible in FIG. 6 and FIGS. 8 and 9.

Each fixture 13 can be configured to receive and retain a coupling portion 14 of a respective containing unit 11. In a preferred example, the coupling portion 14 has a shape mating with the shape of the fixture 13 so as to be insertable in, and completely removable from, the fixture 13.

The support members 12 can be dimensioned and configured to support any desired number and type of containing units. The support members can for example be configured to support, by way of example, up to thirteen containing units 11 disposed adjacent (FIGS. 1 and 2), and therefore comprise as many fixtures 13 each engaged by a respective coupling portion 14.

Figure 2:
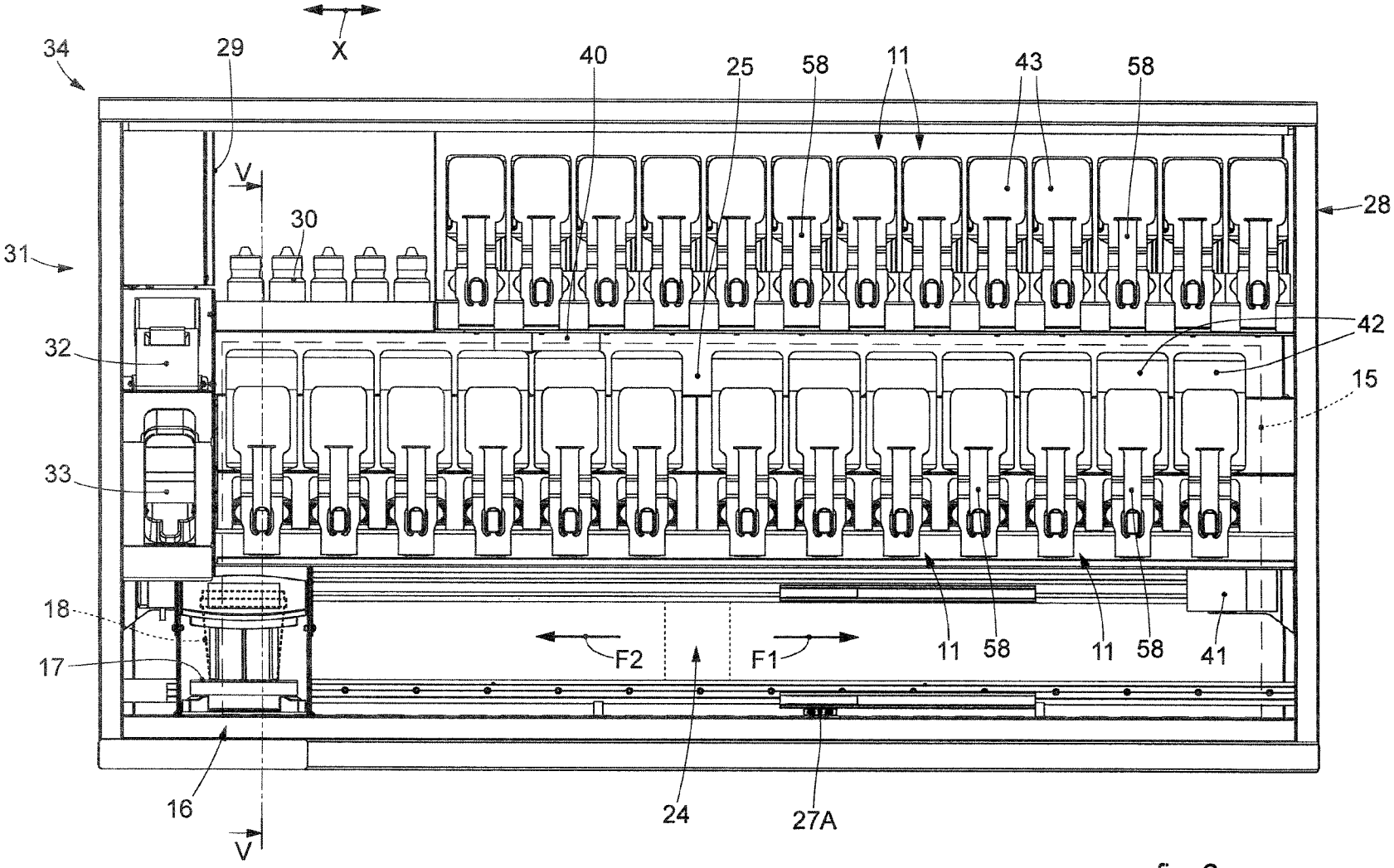
FIG. 2 is a front view in elevation of a portion of the dispensing machine of FIG. 1, in which some elements have been removed for the sake of clarity.

A dispensing zone 15 is defined in the dispensing machine 10, indicated by a dotted line in FIG. 2.

The support members 12, and the containing units 11 supported by them, are disposed in the dispensing zone 15.

According to the present invention, the support members 12 are elongated and may in particular have a linear extension in a direction parallel to a longitudinal direction X. The elongated support members are generally disposed such that the longitudinal direction X is substantially parallel to the ground the machine is installed on.

In the depicted example, the dispensing machine 10 comprises a scale 16, as a non-limiting example of a metering means suitable to meter a quantity of fluid product that has been delivered.

The scale 16 may for example be a digital scale, of a type known in the art, having a sensitivity of 0.02 grams or better.

The scale 16 may be arranged on the translation means and comprise a support plane 17 on which a receptacle 18 can be disposed, inside which the different fluid products are delivered to obtain the desired formulation.

According to the present invention the receptacle 18 can for example be a can or other container, open at the top, with a substantially cylindrical or truncated cone shape, and having a capacity suitable to contain the expected quantity of the desired formulation.

According to the illustrated exemplary dispensing machine, the scale 16 may be disposed on a slider 20 (FIGS. 3 and 4), which is moveable on linear guides 21, 22 (FIG. 3), which define guide means of the slider 20.

The slider 20 may for example be attached both to an upper guide 21*a*, and to a lower guide 21*b*.

Optionally, the slider 20 may also be attached to a motorized guide 22, which extends parallel to the upper and lower guides 21*a*, 21*b* and is interposed between them. A drive motor 23 is associated with the motorized guide 22 and causes a movement of the slider 20 along the linear guides 21, 22.

Due to the linear guides 21, 22, the slider 20 can slide parallel to the longitudinal direction X according to the directions indicated by the arrows F1, F2. In this way, the slider 20, and with it the scale 16 and the receptacle 18, can move below all the containing units 11 disposed in the dispensing zone 15.

Optionally, visual signaling means can be provided, for example configured as one or more strips of LED lights (not shown), which are associated to the dispensing zone 15 to inform the user, possibly located also distant from the dispensing machine, about the status of the dispensing cycle or of the dispensing machine. In one example, the strip of LED adheres to the entire length of the lower guide 21*b*.

By way of example, the strip/strips of LED lights may assume a blue color when the dispensing machine is performing a dispensing cycle, a green color when the cycle is terminated and the machine is ready to run a new cycle, and a red color if the cycle is interrupted because a problem or malfunction is detected.

As mentioned before, the dispensing machine 10 may optionally comprise a removal position 24, in which the receptacle 18 can be removed by the operator.

For instance, the removal position 24 can be disposed in an intermediate position of the dispensing zone 15, about halfway (e.g. 50±10%) with reference to the dimension of the elongated support means in the longitudinal direction X.

In the operation of the machine, the slider 20 may for example be moved into the removal position 24 at the end of the delivery of the fluid product, so that the operator can remove the receptacle 18 which has been filled with the desired formulation and/or add additional ingredients manually.

The dispensing machine 10 may comprise a reference interspace 25 which separates two adjacent containing units 11 by a space larger than the distance between the other containing units 11 disposed in the dispensing zone 15.

The reference interspace 25 may be disposed above the removal position 24 and serve as a visual reference for the operator who, even at a distance, easily identifies the removal position 24 below.

The reference interspace 25 may for example separate two groups of containing units 11, each comprising six and seven containing units 11, respectively disposed to the left and right of the reference interspace 25 as depicted in FIG. 2.

According to the illustrated example, the dispensing machine 10 may further comprise protection elements 26 which shield at the front that part of the dispensing zone 15 where the slider 20 slides for the sake of a safe operation.

The protection elements 26 may for example extend in the longitudinal direction X at least for the whole length of the linear guides 21, 22, below the containing units 11 disposed in the dispensing zone 15.

The protection elements 26 may be transparent. This is advantageous since it allows the users to see the slider 20 during its linear motion while the dispensing machine is operating which is for example helpful for demonstration purposes as well as visual detection of a possible malfunction.

The protection elements 26 optionally comprise a door 27 which is selectively openable by the operator to access the removal zone 24.

For example, the door 27 may be configured to slide to retract inside one of the protective elements 26 adjacent to it.

According to a preferred practice according to the present invention, electrically commanded control 27A door securing devices are associated with the door 27, which selectively prevent the door 27 from opening when the slider 20 is moving.

According to the present invention, the dispensing machine 10 may comprise one or more than one storage zone 28 configured to store a plurality of containing units 11, among which those to be disposed on the support members 12 of the dispensing zone 15 can be selected.

A storage zone 28 can for example be disposed above and/or below the dispensing zone 15.

The storage zone(s) 28 may comprise respective support members, for example similar to the support members 12 described above in the context of the dispensing zone 15, to support and retain the coupling portions 14 of the containing units 11.

In the storage zone 28 the containing units 11 can be disposed adjacent to each other, so as to define a sort of support shelf, which extends parallel to the longitudinal direction X. In other words, in the storage zone 28 the containing units 11 may be stored in a row that is parallel and above or below the row of containing units 11 disposed in the dispensing zone 15.

The storage zone 28 may optionally comprise an auxiliary compartment 29 configured to receive one or more accessory elements 30 useful for completing the formulations.

For example, the accessory elements can comprise jars or bottles 30 containing additives or substances which the operator may want to add manually into the receptacle 18 for instance after it has been filled, at the end of the delivery of the fluid products.

In addition or alternatively, the dispensing machine 10 may comprise a compartment 31 adjacent to the dispensing zone 15 and to the auxiliary compartment 29, if present. The compartment 31 may comprise one or more auxiliary device(s).

Thus, the dispensing machine 10 according to the present invention may for example comprise a printer 32 suitable to print labels that the operator can affix to the receptacle 18. For example, the printer 32 can be configured as a labeling machine of a type known in the state of the art.

In addition or alternatively the dispensing machine 10 may comprise a spectrophotometer 33, of a type known in the state of the art, suitable to examine samples of color formulations. Other auxiliary devices potentially useful according to the present invention include, without being limited thereto, a paint shaker or mixer.

According to the present invention, the printer 32 and/or the spectrophotometer 33 and/or any other auxiliary device(s), if present, may be disposed in the compartment 31.

The dispensing machine 10 according to the present invention can be formed by a plurality of adjacent modular elements 34, 35, 36, which can be reciprocally joined together.

A first modular element 34, or main module, is visible enlarged in FIG. 2 and comprises the dispensing zone 15, a storage zone 28 and the compartment 31.

The first modular element 34 may for example have a length of approximately 2 meters in the longitudinal direction X, a height of approximately 1 to 1.5 meters and a depth of approximately 0.5 meter.

A second and a third modular element, respectively indicated by reference numbers 35 and 36, define other storage zones 37 of the containing units 11 which, if necessary, can be taken by the operator to be disposed in the dispensing zone 15.

Owing to the second and third storage zones 37, the dispensing machine 10 according to the invention may store a large number of containing units 11, for example up to eighty containing units 11 (in addition to the ones disposed in the dispensing zone 15), in particular the number of containing units 11 can be between fifty and eighty containing units 11.

The first modular element 34 may for example be located above the second modular element 35, while the third modular element 36 can be at the (left or right) side of the remaining modular elements 34, 35, for example disposed perpendicular to them or aligned to them in order to provide an extension along longitudinal axis X.

The second modular element 35 typically has approximately the same length and depth as the first modular element 34 that is superimposed to it, but may have a height less than 1 meter, for example of approximately 800 mm.

It is understood that various other configurations of the modular elements are possible. Furthermore, the dispensing machine 10 according to the present invention can comprise only the first modular element 34, and other storage zones 37 of the containing units 11 can be disposed in a dedicated store, distant from the dispensing machine 10.

In a particular variant, in the second modular element 35 the containing units 11 are disposed in two rows one above the other, whereas in the third modular element 36, the containing units 11 are disposed in multiple rows, of shorter length, one above the other.

Both the second modular element 35 and the third modular element 36 may comprise suitable support members, for example similar to the support members 12 described above, able to support and retain the containing units 11.

The modular elements 34, 35, 36 may each comprise a substantially parallelepiped-shaped frame 38 which is open at the front, so that the operator can easily remove the containing units 11 contained therein.

A rolling coverage 39 may optionally be associated with each frame, for example configured as a covering blind, sliding inside its own guides to close the front of each frame 38.

In FIG. 1, in a partly lowered portion, only the rolling coverage 39 associated with the third modular element 36 is shown, while the respective rolling coverage 39 associated with the first and second modular elements 34, 35 are not visible because they are completely raised so as to facilitate the clarity of the drawing.

Optionally, the dispensing machine 10 may further comprise heating elements 40, for example configured as electrical resistances of a type known in the art, and one or more temperature sensors 41 (of a known type) both shown schematically in FIG. 2.

The heating elements 40 can for example be disposed in proximity to the storage zones 28, 37 in order to heat the containing units 11 stored therein. During use, the heating elements 40 may be activated when the temperature detected by the temperature sensor(s) 41 is lower than a certain predetermined threshold, for example equal to 5° C.

With particular reference to FIGS. 4-6 and FIGS. 8 and 9, we will now describe the containing unit 11 of the fluid product in greater detail.

The containing unit 11 generally comprises a container 42 for the fluid product such as a coloring fluid product.

Containers 42 of different shapes, materials and dimensions can be used according to the present invention. The container 42 is usually made of a solid material and has a predetermined shape defining a cavity to contain the fluid product. Suitable containers 42 comprise for example bottles, cans, buckets, canisters, boxes, bags or other package forms known in the art as containers for fluid ingredients. The containers 42 can be made from different materials such as metals or plastic materials. The containers 42 can have a self-consistent form, optionally with some elasticity, e.g. to allow for some reversible deformation upon installation to a fixture or auxiliary supporting member 19, which may be used to secure the containers 42 in the dispensing machine of the present invention. The container 42 can have, by way of example, a volume in a range from 100 mL up to 5 liters, such as 0.5 liters, 1 liter, or 2 liters.

The containing unit 11 may also comprise a body 44 to which the container 42 is removably connected. The term "removably connected" means that the container can be reversibly connected to the body of the containing unit, which thus serves as a temporary carrier of the container. Accordingly, the container can in particular be manually connected to the body and removed therefrom again in a non-destructive manner.

For example, the container 42 may have a mouth 42*a*, externally threaded, which allows the container 42 to be screwed inside a threaded mount 44*a* which is made in the body 44. Other types of connections such as a snap-fit connection can also be utilized.

The containers can have a cap, lid, seal or alike to keep them closed upon storage. The cap, lid, seal or alike may be removed from the container prior to use, e.g. when mounting the container to the body 44 of a containing unit 11 for use in the dispensing machine of the present invention.

Typically, the container 42 is disposed upside down, with the mouth 42*a* facing down and the bottom upward.

The containing unit 11 may comprise a front wall 43, positioned above a front portion of the container 42, and configured to receive an identifying label of the fluid product contained in the container.

FIGS. 8 and 9 illustrate an exemplary variant of the containing unit 11 that can be used according to the invention. According to this variant, each fixture 13 comprised in the supporting member 12, and intended to receive and retain the coupling portion 14 of a respective containing unit 11, may comprise a pair of supporting elements 15A, 15B that act as lateral guides during the insertion and the removal of the containing unit 11 in/from the fixture 13, at the same time supporting the coupling portion 14 from below and from the sides. For this purpose, the supporting elements 15A, 15B are shaped to surround the sides and, at least partially, the bottom of the coupling portion 14.

As illustrated in FIGS. 8 and 9, the fixture 13 may further comprise an auxiliary supporting member 19 that is fixed to the supporting elements 15A, 15B and protrudes upwards therefrom. The auxiliary supporting member 19 is configured to engage the body 44 at the mount 44*a*, at least partially surrounding the latter from the outside. In some examples, the auxiliary supporting member 19 may comprise two arms 19A, 19B provided with some elasticity in order to alternatively snap or disengage to/from the mount 44*a*, respectively during insertion or removal of the containing body 11 in/from the respective fixture 13.

The containing unit 11 may further comprise a handle 58, which allows the operator to easily grasp the containing unit 11. It should be noted that in the variant shown in FIGS. 8 and 9 the shape of the handle 58 is different from the one of the embodiment shown in FIG. 6 and can be particularly ergonomical to facilitate the user grasping the containing unit 11.

The containing unit 11 may further comprise delivery means for delivering an amount of the contained fluid product. For example, it may comprise a pump assembly 45, of a type known in the art, which for this reason will not be described here in detail. The pump assembly 45 can, for example, be a bellows pump with an alternating movement of the pumping element.

Figure 4:
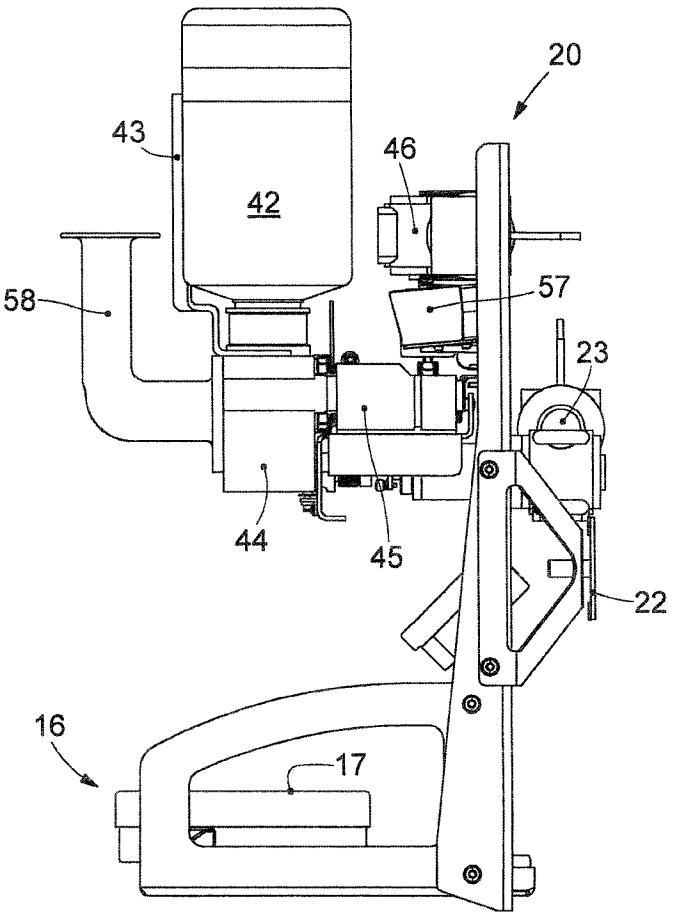
FIG. 4 is a lateral view in elevation of a slider and a containing unit of a coloring fluid product comprised in the dispensing machine of FIG. 1.
Figure 3:
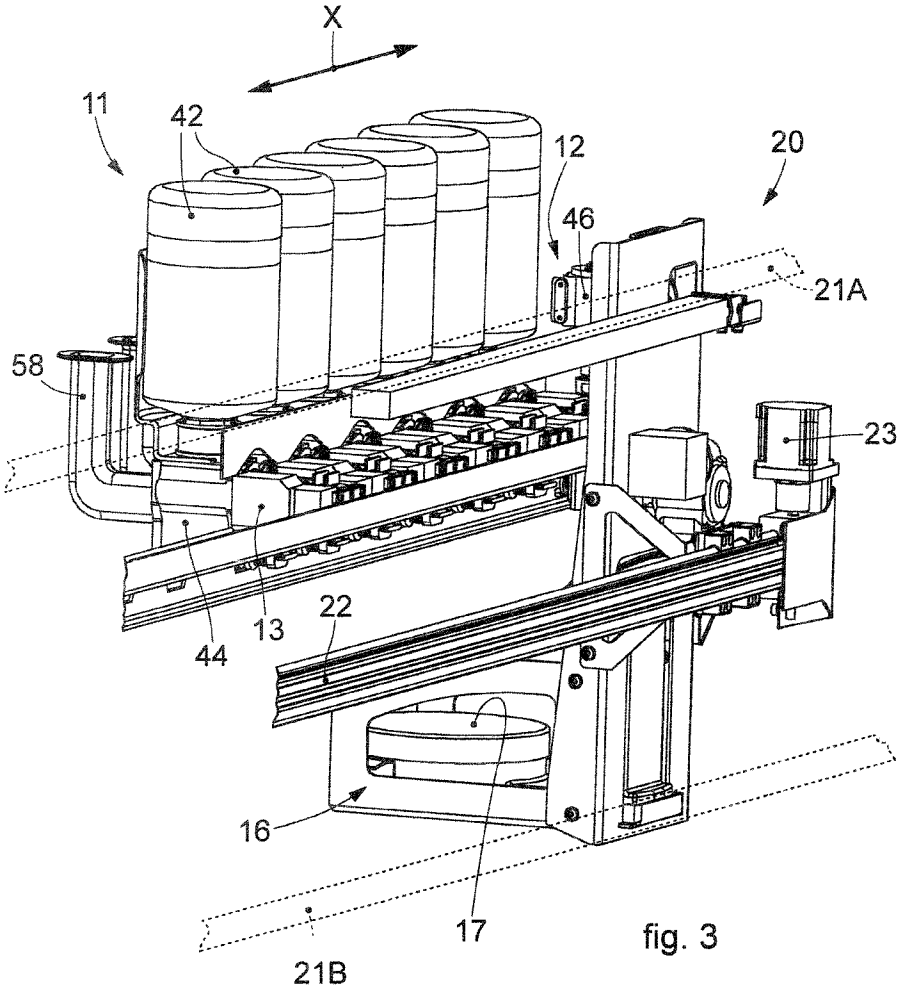
FIG. 3 is a rear and partial perspective view of another portion of the dispensing machine of FIG. 1.
Figure 5:
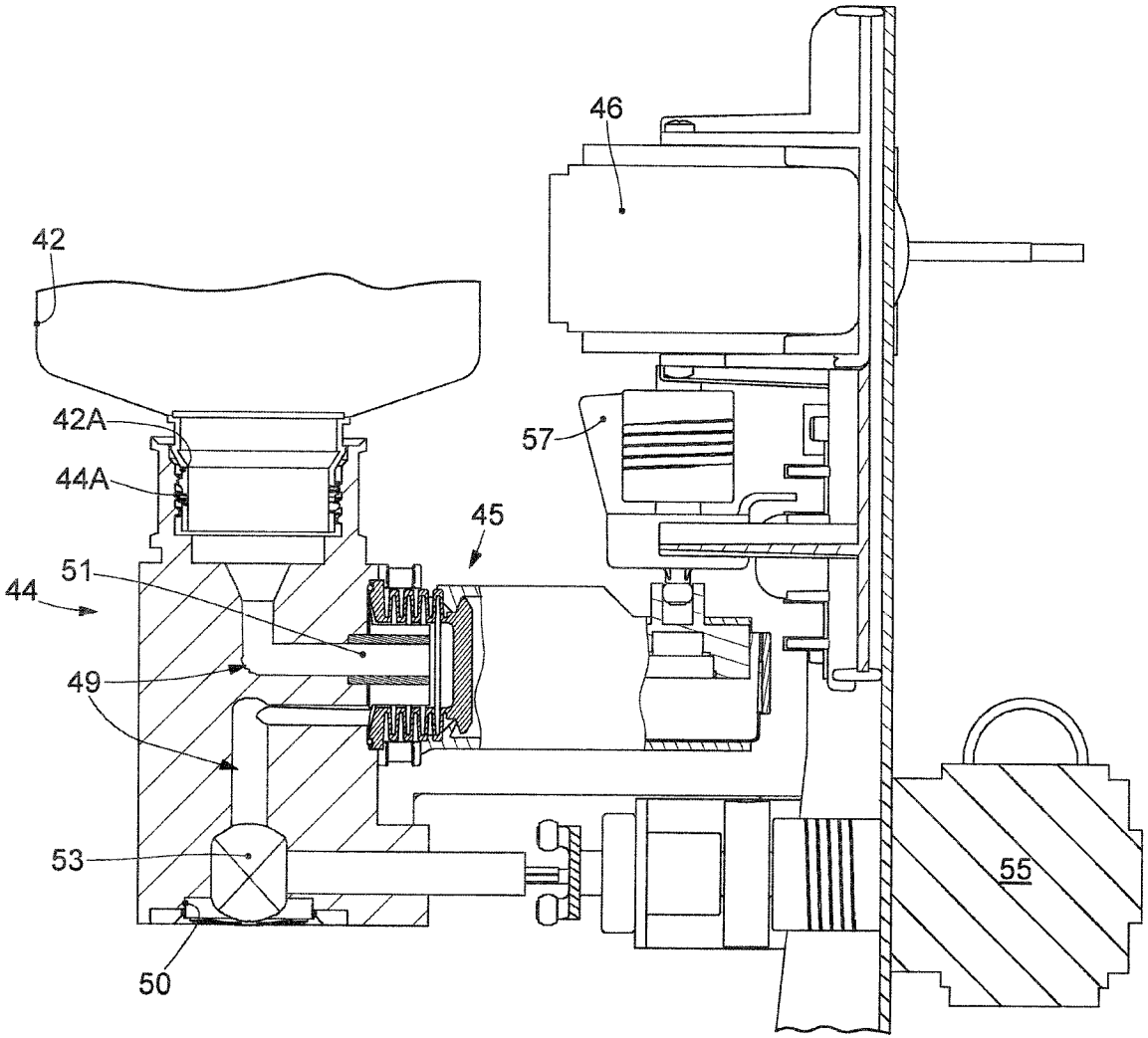
FIG. 5 is a partial and schematic section view of a containing unit comprised in the dispensing machine, taken according to the section plane V-V of FIG. 2.

The pump assembly 45 can for example be operated by a motor of the pump assembly, indicated by the number 46 and visible in particular in FIGS. 3-5, which defines means to drive the pump assembly 45. The pump assembly 45 can be comprised by the body 44 of the containing unit 11. In one preferred example, the pump assembly 45 is disposed in the coupling portion 14 of the containing unit 11, which is defined as that portion of the latter protruding rearward from the body 44.

According to the illustrated example described here, in the body 44 a pipe arrangement 49 is made. The pipe arrangement 49 connects the container 42 with an outlet 50 of the containing unit 11, in correspondence of which the fluid product is delivered to the underneath receptacle 18. The pipe arrangement 49 defines a pathway for the fluid products along which the pump assembly 45 is disposed.

A control valve 53, shown schematically in FIG. 5, may be provided along the pipe arrangement 49 disposed adjacent to the outlet 50.

The control valve 53 can be a valve known in the art that allows controlling the flow of the fluid products in the body 44. The control valve 53 can be controlled by driving means 55 operatively associated with the control valve 53 as schematically shown in FIG. 5.

According to the present invention, the motor 46 of the pump assembly can be disposed on the slider 20 and is moveable together with it.

Also the driving means 55 of the control valve 53 can be disposed on the slider 20.

It should be noted that this advantageously allows each containing unit 11 to be free of motor means. In fact, when the fluid product is delivered from a certain containing unit 11, the slider 20 carrying the motor means is disposed in correspondence with the latter. In this way, the same motor 46 is operatively associated, time by time, with the pump assembly 45 comprised in the containing unit 11 from which the fluid product is to be delivered. In fact, as better shown in FIG. 5, the motor 46 is mechanically connected with one of the pump assembly 45 at a time, for making this pump assembly 45 delivering the fluid product.

Furthermore, an optical reader 57 may optionally also be disposed on the slider 20, and defines optical detection means configured to detect an identification code that is univocally associated with each containing unit 11.

The optical reader 57 may for example be a bar-code reader known in the art.

The machine 10 may further comprise a display 59, for example of the touchscreen type, which defines interface means through which the operator can control the functioning of the machine 10.

The display 59 can for example be supported by a mechanical arm 60 hinged to the frame 38 of the first or second modular element 34, 35.

The machine 10 may further comprise a controller, not shown in the figures and of a type known in the art.

The controller may be operationally linked to the actuation means, embodied for example as the drive motor 23, and/or to the metering means, embodied for example as the digital scale 16, and/or to the delivery means or components thereof, such as for example the motor 46 of the pump assembly 45 and the driving means 55 associated with the control valve 53. In use, the controller may be configured to command the actuation means to move the receptacle 18 via the translation means 20 sequentially to the dispense positions below one or more of the containing units 11 to receive each a quantity of fluid product dispensed, e.g. via the delivery means, from the respective containing unit 11 as metered by the metering means 16 to produce a formulation according to a user-defined recipe.

Figure 10:
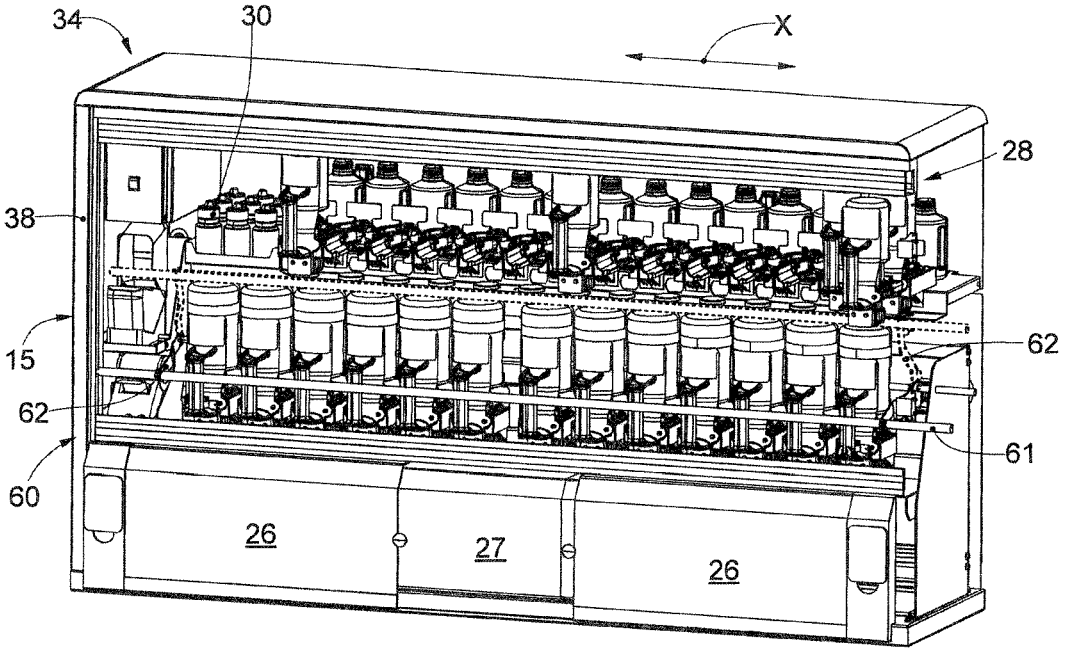
FIG. 10 is a perspective view of another variant of the dispensing machine according to the invention, in which it is visible only a portion of the machine with some components removed for the sake of clarity.
Figure 11:
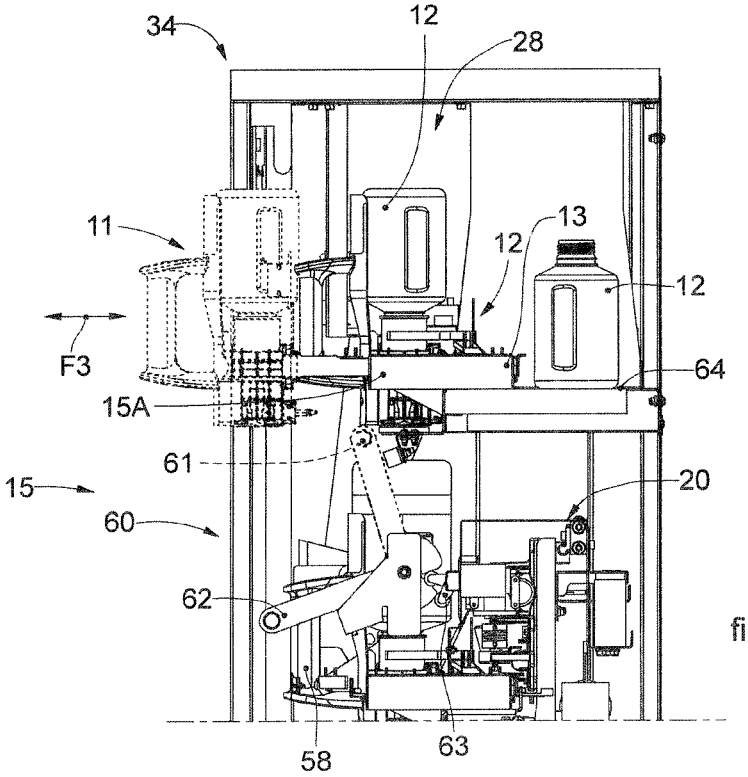
FIG. 11 is a partial lateral view of the variant of the dispensing machine shown in FIG. 10.

With particular reference to FIGS. 10 and 11, we will now describe a variant of the dispensing machine 10 according to the invention. In the following description, only the parts of the machine differing from the embodiments of the machine disclosed above will be disclosed.

According to this variant, the dispensing machine comprises a roll bar unit 60, which is alternatively movable between a lowered position and a raised position, the latter being shown in dashed lines in the figures.

In some form of embodiment, the roll bar unit 60 comprises an elongated rod 61, which in particular extends substantially for the entire length of the main cabinet 34, parallel to the longitudinal direction X.

The elongated rod 61 is supported by brackets 62, positioned for example at opposite sides of the main cabinet 34. Each bracket 62 is connected to the frame 38 in a hinged-like manner so as to allow the roll bar unit 60 to be moved from the lowered position to the raised position and vice versa.

In this variant, an electrically commanded control member 63 (FIG. 11) can be provided that is operationally associated to the roll bar unit 60. The electrically commanded control member 63 may comprise a microswitch, of a type known in the art. In one particular example, at least one of the brackets 62 is in contact with the electrically commanded control member 63 so as to selectively power the machine as a function of the position of the roll bar unit 60.

For example, when the roll bar unit 60 is in the raised position the electrically commanded control member 63 can be in an open configuration so as to not power the dispensing machine, whilst when the roll bar unit 60 is in the lowered position the electrically commanded control member 63 can be in a closed configuration, thus powering the machine.

The roll bar unit 60 advantageously enhances the safety of the dispensing machine because the users cannot remove any containing units 11 that are temporarily disposed in the dispensing zone 15 whilst the machine is running. In fact, as better visible in FIG. 11, when the roll bar unit 60 is in the lowered position, and the dispensing machine is powered since the electrically commanded control member 63 is in the closed configuration, the elongated rod 61 obstructs the removal of the containing units 11 from the support member 12 placed in the dispensing zone 15. Only when the roll bar unit 60 is in the raised position and the machine is not powered since the electrically commanded control member 63 is in the open configuration, the elongated rod 61 allows the removal and the placing of the containing units 11 from/in the support member 12 of the dispensing zone 15 in the direction indicated by the arrow F3. In fact, as shown in FIG. 11, when the roll bar unit 60 is in the lowered position the elongated rod 61 is in front of the containing units 11 adjacent to the handle 58, whilst when the roll bar unit 60 is in the raised position (dashed in FIG. 11) the elongated rod 61 is above the containing units 11 adjacent to the bottom of the container 12. In FIG. 11, one containing unit 11 in front of the upper storage zone 28 is depicted to show the trajectory of the containing units 11 during their placing or removal from the support members 12, either of the storage zones 28 or of the dispensing zone 15.

Owing to the roll bar unit 60 it is possible to ensure that when the machine is running it is not possible to add or remove any containing units 11 to/from the dispensing zone 15. This is important because it can prevent significant damages to the machine. In fact, due to the cooperation between the translation means 20 (carrying the motor 46 of the pump assembly 45 and the driving means 55 of the valve 53) and the containing units 11 placed in the dispensing zone 15, it is evident that structural damages may occur to the machine if the user tries to remove from the respective fixture 13 exactly the containing unit 11 which is currently engaged by the motor 46.

A double check may be provided for to selectively power the dispensing machine only when both the electrically commanded control members 27A, 63 are in the respective closed configuration, so as to be sure that the door 27 is correctly closed, and the roll bar unit 60 is in the lowered position.

As also shown in FIG. 11, an additional storage shelf 64 can optionally be provided. The additional storage shelf 64 can be placed in the storage zone 28 disposed above the dispensing zone 15, in particular towards the rear of the machine, behind the support members 12 of this dispensing zone. The additional storage shelf 64, extending for example along the entire length of the main cabinet 34 parallel to the longitudinal direction X, is configured to store a row of containers 12, which are intended to replace other corresponding containers containing the same fluid products once the latter will be finished. This allows to keep filled containers for storage purposes inside the machine, in an unexploited zone so as to efficiently use space.

It is clear that modifications and/or additions of parts can be made to the machine as described heretofore, without departing from the field and scope of the present invention.

The dispensing machine according to the present invention can be used to efficiently prepare a customized formulation, such as a color formulation. The present invention is accordingly also directed to a method for preparing a user-defined target formulation from a plurality of fluid products.

Figure 7:
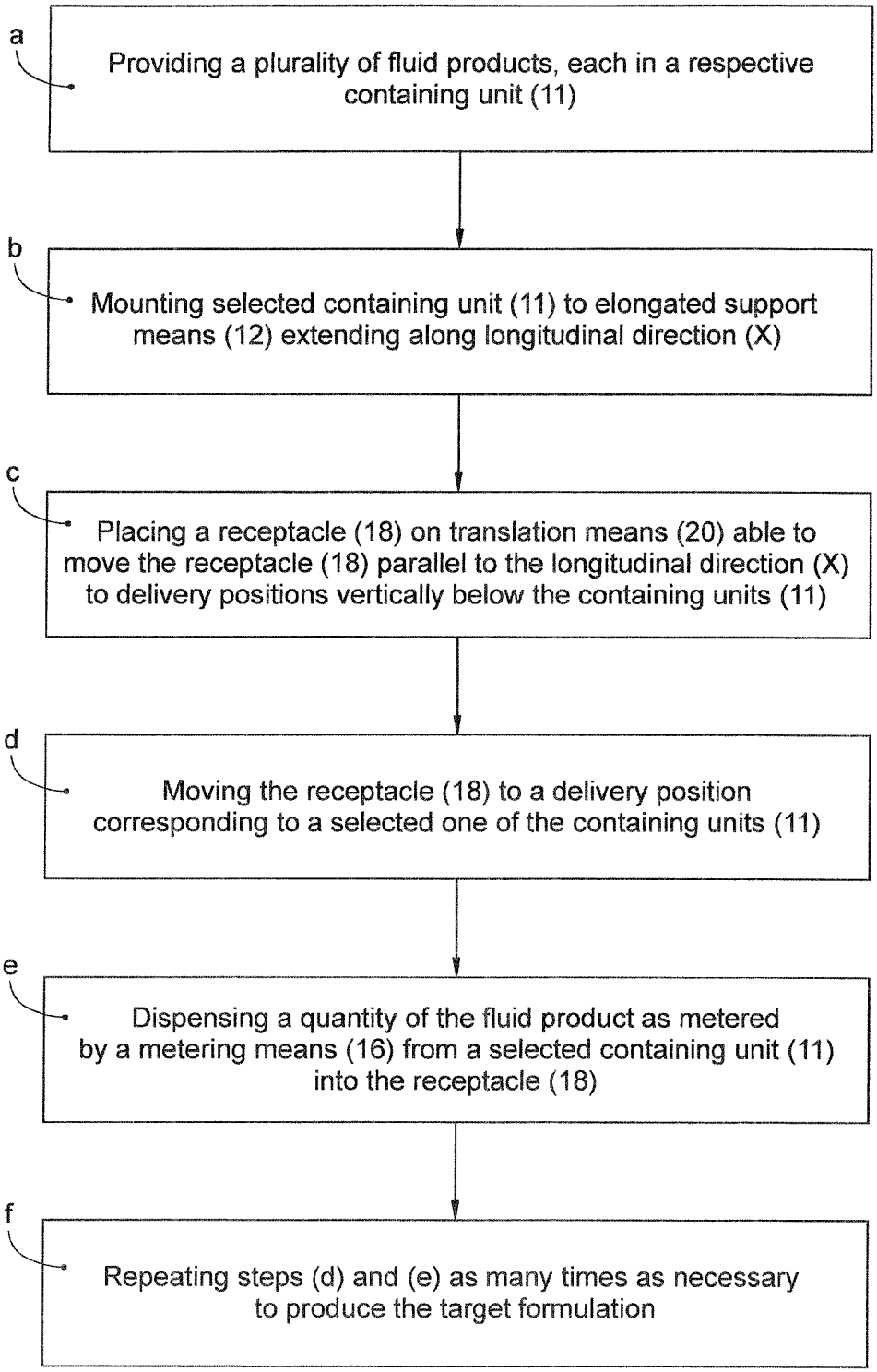
FIG. 7 is a flow diagram illustrating the sequence of steps of a dispensing method for preparing user-defined formulations from a plurality of dispensable fluid products in accordance with the present invention.

As illustrated in FIG. 7 this method comprises in accordance with a preferred mode of operation of the aforedescribed dispensing machine:

(a) providing a plurality of fluid products each disposed in a respective containing unit 11;

(b) mounting the containing units 11 of the fluid products to elongated support means 12 configured to support the plurality of containing units 11 of the fluid products in a stationary manner along a longitudinal direction X;

(c) placing a receptacle 18 intended for receiving fluid product from the containing units 11 on translation means 20 configured to allow moving the receptacle 18 substantially parallel to the longitudinal direction X to delivery positions substantially vertically below said containing units 11;

(d) moving the receptacle 18 via the translation means 20 to a delivery position corresponding to a selected one of the containing units 11 of fluid products;

(e) dispensing a quantity of the fluid product as metered by the metering means 16 from the selected containing unit 11 into the receptacle 18;

(f) repeating steps (d) and (e) to produce the target formulation according to a user-defined recipe.

The different components made use of in the method of the present invention such as the support means 12, containing units 11, translation means 20, metering means etc. can each be as described beforehand with respect to the dispensing machine. Thus, the fluid products provided in step (a) can for example be provided in containing units 11 of any type and dimension described beforehand. The provided containing units may optionally be subjected to controlled heating to prevent degradation such as drying or solidification of the contained fluid product. The containing units 11 of the fluid products mounted to the support means 12 in step (b) can be selected by the user in accordance with the desired formulation to be produced. They can for example be taken from a suitable storage element such as a storage zone 28, 37 of the dispense machine according to the present invention and be mounted to the support means 12 of the dispensing zone 15. The selected containing units 11 can for example be mounted to the support means 12 by inserting a coupling portion 14 of the containing units 11 in a corresponding fixture 13 comprised by the support means 12 having a mating shape as described above and illustrated for example in FIGS. 8 and 9. The method can optionally comprise identifying the type of fluid products in the mounted containing units, for example by means of detection means as set forth above. The metering means 16 such as a digital scale can in particular be provided on the translation means 20 to be moveable thereby to the different delivery positions. Thus, in step (c) the receptacle 18 can in particular be placed on metering means 16 such as a digital scale disposed on the translation means. Steps (d) to (f) are typically performed in an automated manner for example using driving means and a controller as described above with respect to the dispensing machine. Herein, the sequential positioning of the receptacle 18 via the translation means 20 in the different delivery positions and the dispensing of defined quantities of the respective fluid products can be conducted making use of the information obtained by the afore-mentioned optional identification of the mounted containing units. The dispensing of a fluid product in step (e) can comprise activating delivery means such as any delivery means mentioned above to dispense the respective fluid product. The delivery means can be controlled in response to a signal from the metering means to dispense a targeted quantity of the respective fluid product. The method according to the present invention may optionally further comprise another step (g), which provides moving the receptacle 18 at the end of the dispensing sequence via the translation means 20 to a removal position 24, which can in particular be configured as described above with respect to the construction of the dispensing machine, enabling the operator to complement the formulation process with manual additions.

The present invention has been described with reference to some specific examples, a person of skill in the art shall certainly be able to achieve many other equivalent forms of the machine or method for preparing a user-defined target formulation from a plurality of fluid products, having the characteristics as set forth in the claims and hence all coming within the field of protection defined thereby.

We claim:

1. A dispensing machine for dispensing fluid products comprising elongated support means configured to support a plurality of removable containing units of the fluid products in a stationary manner along a longitudinal direction (X), wherein the elongated support means comprise a plurality of fixtures each shaped so as to receive and retain a coupling portion of said containing units, wherein the containing units comprise a container that contains the fluid product, and a body to which the container is removably connected, the dispensing machine further comprising translation means configured to allow moving a receptacle disposed on the translation means substantially parallel to the longitudinal direction (X) to delivery positions substantially vertically below said containing units metering means configured to meter a quantity of fluid product that is delivered from a containing unit to the receptacle in a delivery position corresponding to the respective containing unit and delivery means for dispensing fluid product from the containing units, wherein the body of the containing units comprises a pump assembly, one or more valve elements and a pipe arrangement able to lead the fluid products from said container to said receptacle, and wherein said translation means, or a component thereof, comprises drive means configured to interact with a respective containing unit of said fluid product in order to command the delivery of said fluid product by selectively operating the pump assembly and one or more valve elements that are integrated in a body of said containing unit.

2. The dispensing machine as in claim 1, wherein the translation means comprise a slider for carrying the receptacle and linear guide means that extend parallel to the longitudinal direction (X), wherein the slider is moveable on the linear guide means.

3. The dispensing machine as in claim 2, wherein said slider comprises detection means configured to detect an identity code univocally associated with each of said containing units.

4. The dispensing machine as in claim 3, wherein the detection means are optical bar code readers.

5. The dispensing machine as in claim 1, wherein the metering means comprise weighing means disposed on the translation means to receive, resting on said weighing means, the receptacle for receiving the delivered fluid products.

6. The dispensing machine as in claim 1, further comprising a removal position where said receptacle is accessible to the operator, which is disposed in a median position of a dispensing zone with reference to said longitudinal direction (X).

7. The dispensing machine as in claim 6, comprising protection elements that shield said translation means from the operator and are provided with a door which can be opened by the operator in order to access said removal zone.

8. The dispensing machine as in claim 7, wherein the protection elements are transparent.

9. The dispensing machine as in claim 7, wherein the door is selectively secured in the closed position by electrically commanded control securing devices at least when said translation means is moving.

10. The dispensing machine as in claim 1, wherein the plurality of containing units supported by the elongated support means from which the fluid product is delivered are disposed in a dispensing zone and the machine further comprises a storage zone configured to store a plurality of containing units of fluid products outside said dispensing zone.

11. The dispensing machine as in claim 10, further comprising heating means and temperature sensor means, wherein said heating means are disposed within or in proximity to said storage zone in order to heat the containing units stored therein in response to the temperature detected by said temperature sensor means.

12. The dispensing machine as claim 10, further comprising an additional storage shelf that is placed in the storage zone disposed above said dispensing zone and extends parallel to the longitudinal direction (X) to store a row of containers filled with respective fluid products.

13. The dispensing machine as in claim 1, wherein the dispensing machine comprises a drive motor associated with said translation means for moving said translation means along said longitudinal direction (X).

14. The dispensing machine as in claim 13, further comprising a controller operationally linked to the drive motor, the metering means, and optionally a delivery means, wherein the controller commands the drive motor to move the receptacle via the translation means sequentially to dispense positions below one or more of the containing units to each receive a quantity of fluid product dispensed from the respective containing unit as measured by the metering means to produce a formulation according to a user-defined recipe.

15. The dispensing machine as in claim 1, wherein the coupling portion of the containing units has a shape mating with the shape of the fixtures so as to be insertable in, and completely detachable from, the fixtures.

16. The dispensing machine as in claim 1, further comprising a printing device configured to print adhesive labels suitable to adhere to said receptacle and/or a spectrophotometer device suitable to analyze the formulations to be delivered by said dispensing machine, and/or a computer and/or a display, and/or a shaker device able to shake the formulations delivered in said receptacle.

17. The dispensing machine as in claim 1, comprising a plurality of joined sectional modules, with a main module comprising at least a dispensing zone and optionally one or more storage zone(s) and one or more additional module(s) comprising other storage zones for containing units of the fluid products forming a main cabinet and optionally one or more further module(s) comprising additional storage zones for containing units of the fluid products forming one or more than one secondary cabinet.

18. The dispensing machine as in claim 17, wherein the main module has a width of equal to or less than 2.0 m, a height of up to 2.0 m and/or a depth of equal to or less than 60 cm and/or the optional secondary cabinet has a width of equal to or less than 80 cm, a height of up to 2.0 m and/or a depth of equal to or less than 60 cm.

19. The dispensing machine as in claim 17, further comprising coverage means associated to the dispensing zone and/or to one or more storage zone(s) configured to store a plurality of said containing units of fluid products outside said dispensing zone, said coverage means comprising shutters and/or blinds that are configured to reversibly, close said dispensing zone and/or storage zone(s) in order to protect the containing units disposed therein.

20. The dispensing machine as in claim 1, further comprising visual signaling means which are associated with said dispensing zone to inform a user about the state of a dispensing cycle or of the machine.

21. The dispensing machine according to claim 20, wherein the visual signaling means are configured as one or more LED lights.

22. The dispensing machine as in claim 1, further comprising a roll bar unit comprising an elongated rod extending parallel to said longitudinal direction (X) and supported by brackets hingedly connected to a frame so as to allow a movement of said roll bar unit between a lowered and a raised position, in which respectively said elongated rod prevents or allows the insertion of said containing units in a dispensing zone or their removal therefrom.

23. The dispensing machine according to claim 4, further comprising an electrically commanded control member that is operationally associated to said roll bar unit and configured to be in contact with said brackets so as to alternatively assume an open configuration, in which the dispensing machine is not powered, at least when said roll bar unit is in the raised position, and a closed configuration, in which the dispensing machine is powered, at least when said roll bar unit is in the lowered position.

24. A method of using a dispensing machine as in claim 1 for preparing user-defined formulations of fluid products which may comprise a body shop for painting a vehicle body.

25. The method of using a dispensing machine as in claim 24, wherein the fluid products are paint formulations for refinishing or repair purposes.

26. A method for preparing a user-defined target formulation from a plurality of fluid products, the method comprising:

(a) providing a plurality of fluid products each in a containing unit, wherein the containing units comprise a container that contains the fluid product, and a body to which the container is removably connected;

(b) mounting the containing units of the fluid products to elongated support means configured to support the plurality of containing units of the fluid products in a stationary manner along a longitudinal direction (X);

(c) placing a receptacle intended for receiving fluid product from the containing units on translation means configured to allow moving the receptacle substantially parallel to the longitudinal direction (X) to delivery positions substantially vertically below said containing units;

(d) moving the receptacle via the translation means to a dispense position corresponding to a selected one of the containing units of fluid products;

(e) dispensing a quantity of the fluid product as metered by metering means from the selected containing unit into the receptacle through delivery means for dispensing fluid product from the containing units, said delivery means comprising a pump assembly, one or more valve elements and a pipe arrangement able to lead fluid products from said container to said receptacle, and wherein said dispensing further comprises interaction of drive means of said translation means or a component thereof with a respective containing unit of said fluid product in order to command the delivery of said fluid product by selectively operating the pump assembly and said one or more valve elements that are integrated in the body of the respective containing unit;

(f) repeating steps (d) and (e) to produce the target formulation according to a user-defined recipe.

27. The method as in claim 26, wherein (b) mounting the containing units of the fluid products to the elongated support means comprises inserting a coupling portion of said containing units in a corresponding fixture of said support means having a shape mating with the shape of the coupling means.

* * * * *